US007708426B2

(12) United States Patent
Dalton et al.

(10) Patent No.: US 7,708,426 B2
(45) **Date of Patent: *May 4, 2010**

(54) RECHARGEABLE FLASHLIGHT

(75) Inventors: David R. Dalton, Turramurra (AU); Michael Squires, Ryde (AU); Kw Au, Kowloon (CN); David J. Alessio, Amherst, OH (US); Siu Bong Ng, Sha Tin (HK)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/838,411

(22) Filed: Aug. 14, 2007

(65) Prior Publication Data

US 2007/0279901 A1 Dec. 6, 2007

Related U.S. Application Data

(63) Continuation of application No. 10/505,913, filed as application No. PCT/AU02/01751 on Dec. 31, 2002, now Pat. No. 7,273,293.

(51) Int. Cl.
*F21L 4/08* (2006.01)

(52) U.S. Cl. ..... 362/183; 362/20; 362/205; 362/194; 320/114

(58) Field of Classification Search ..... 362/183, 362/200, 203, 205, 208, 194–196, 201; 320/114, 320/115

See application file for complete search history.

(56) References Cited

U.S. PATENT DOCUMENTS 3,067,373 A 12/1962 Hopt et al
3,109,132 A 10/1963 Witte
4,530,040 A 7/1985 Petterson
4,635,171 A 1/1987 Beiswenger
4,794,315 A * 12/1988 Pederson et al. ..... 320/111
4,903,178 A 2/1990 Englot et al.
4,999,750 A * 3/1991 Gammache ..... 362/203
5,006,779 A * 4/1991 Fenne et al. ..... 320/111
5,138,351 A * 8/1992 Wiegand et al. ..... 320/111

(Continued)

FOREIGN PATENT DOCUMENTS

DE 4104883 A1 8/1992

(Continued)

*Primary Examiner*—Sandra L O'Shea
*Assistant Examiner*—Leah S Lovell
(74) *Attorney, Agent, or Firm*—Gregory J. Adams

(57) ABSTRACT

The present invention provides a flashlight or device having a body with a battery, and a circuit therebetween; recharging terminals for recharging the battery and an adaptor having electrical connectors for connecting to a power supply; structural connection means on the body and or the adaptor to releasably connect the body and the adaptor; and electrical connection means on both the body and the adaptor to releasably electrically connect the terminals and the adaptor.

The present invention also provides a flashlight having a body with a light means at one end, a battery, and a circuit therebetween, so that when the circuit is closed the light means will generate light; the light means including a conical reflector, a white light LED emitting a conical light output and a double convex lens portion, the double convex lens portion being located away from the LED so that the outside diameter of the double convex lens portion will a circle of light from the LED which is of substantially the same diameter.

24 Claims, 10 Drawing Sheets

U.S. PATENT DOCUMENTS 5,635,814 A * 6/1997 Afzal et al. ..... 320/111
5,684,378 A * 11/1997 Furth et al. ..... 362/183
5,806,961 A * 9/1998 Dalton et al. ..... 362/183
5,908,233 A * 6/1999 Heskett et al. ..... 362/183
6,752,514 B2 6/2004 Parker
2001/0033481 A1 * 10/2001 Chien ..... 362/34
2002/0064041 A1 * 5/2002 Parker ..... 362/183

FOREIGN PATENT DOCUMENTS

DE 20114358 U1 11/2001
GB 810256 A 3/1959
WO 02/14738 A 2/2002

* cited by examiner

RECHARGEABLE FLASHLIGHT

FIELD OF THE INVENTION

The present invention relates to rechargeable flashlights, devices, their use and operation.

BACKGROUND OF THE INVENTION

Rechargeable flashlights have been known for a considerable time. Disclosed in U.S. Pat. No. 5,847,540 is a rechargeable flashlight having a plug unit supported in the flashlight housing for rotation between a non-charging position, in which blades of the plug unit are retracted into the housing, and a charging position in which the blades are projecting from the housing for insertion into an AC outlet. The plug unit co-operates with a switch unit in the housing for connecting a rechargeable battery to a bulb circuit and disconnecting the battery from a charging and indicating circuit when the plug unit is in the non-charging position. The switch unit also disconnects the battery from the bulb circuit and connects the battery to the charging circuit and indicating circuit when the plug unit is in the charging position. This document teaches that the plug unit can be rotated into and out of the body of the flashlight while remaining connected thereto.

Another flashlight is disclosed in U.S. Pat. No. 4,515,790 which has a rechargeable power pack or cartridge which discloses a plug structure for use with standard electricity sockets or supply outlets, whereas the power cartridge also has a shape which allows the plug structure to be utilised for example with a cigarette lighter outlet of a motor vehicle so that the user has the option of recharging from either electricity supply outlets or from a cigarette lighter outlet of a motor vehicle or a boat. The battery is removed from the flashlight as it is a part of the power pack for recharging purposes. The construction thus can result in the separation of the power pack from the flashlight during the recharging process, which will decrease the ready to use state of the flashlight by comparison to the flashlight disclosed in U.S. Pat. No. 5,847,540.

The applicant does not concede that the prior art discussed above forms part of the common general knowledge in the art of the skilled addressee that the priority date of this application.

SUMMARY OF THE INVENTION

The present invention provides a flashlight having: a body with a light means at one end, a battery, and a circuit therebetween, so that when the circuit is closed the light means will generate light; recharging terminals for recharging the battery and an adaptor having electrical connectors for connecting the adaptor to a power supply; structural connection means on the body and/or the adaptor to releasably connect the body and the adaptor; and electrical connection means on both the body and the adaptor to releasably electrically connect the terminals and the adaptor; the recharging terminals being able to be received in the adaptor and the electrical connectors being able to be received in the body when the adaptor is not in use for recharging.

The adaptor and the body have the structural connection means disconnected in order for the electrical connection means to electrically connect the terminals and the adaptor.

The structural connection means can include a female portion on one of the body or the adaptor, with the other having a male portion. The female portion or the male portion when present on the body has the electrical connectors extending therefrom. The female portion or the male portion of the adaptor has the electrical connectors extending therefrom.

The female portion or male portion the body can include cavities to receive the electrical connectors.

The female portion or male portion of the adaptor can include cavities to receive the terminals.

The adaptor can be shaped so that when the structural connection means connect the body and the adaptor, the adaptor is of a shape which substantially matches the shape of the body in the vicinity of the adaptor.

The adaptor can be shaped so that when the structural connection means connects the body and the adaptor is the rear part of the body.

The adaptor can include a socket to receive the recharging terminals.

When the electrical connectors are in a power supply socket with a vertically oriented front face, the adaptor can have an upper face into which the rechargeable terminals are inserted, the upper face being at an angle to the horizontal so that a line normal to the upper face extends away from the adaptor on a divergent path away from the vertical.

The body can have a female portion and the adaptor can have a male portion.

The male portion can be of a shape and or size to fit between the recharging terminals.

The adaptor can include a hinged cover to overlay the electrical connection means on the adaptor.

The hinged cover can act to limit movement of the flashlight on the adaptor when they are electrically connected.

The adaptor can have a first position relative to the body to enable recharging of the battery in which the recharging terminals are received in the adaptor, and another, second position relative to the body, for when the adaptor is not in use for recharging the battery, in which the electrical connectors are received in the body.

The present invention also provides a flashlight having a body with a light means at one end, a battery, and a circuit therebetween, so that when the circuit is closed the light means will generate light; the light means including a frustoconical reflector having a central axis and a reflective surface projecting towards the axis, the reflective surface being straight when viewed in a cross-section of the reflector taken through the axis, a white light LED emitting a conical light output and a double convex lens portion, the double convex lens portion being located away from the LED so that the outside diameter of the double convex lens portion will be struck by a circle of light from the LED which is of substantially the same diameter.

Around the double convex lens portion can be a straight sided lens. The straight sided lens and the double convex lens portion can be integrally formed in a single lens member.

An alternate embodiment of the flashlight provides the light means producing a beam emitted from the flashlight which has four bands of differing light intensity.

Preferably there is a circular centre and at least three annular bands of light there around.

The circular centre preferably has the highest light intensity relative to the annular bands. The first band adjacent to the circular centre preferably has the lowest light intensity relative to the annular bands. The second band adjacent the first band preferably has a light intensity less than the circular centre but greater than the first band. The third band adjacent the second band can have a light intensity less than the second band but greater than the first band.

BRIEF DESCRIPTION OF THE DRAWINGS

An embodiment of the present invention, will be described by way of example only, with reference to the accompanying drawings, in which.

DETAILED DESCRIPTION OF THE EMBODIMENTS

Figure 1:
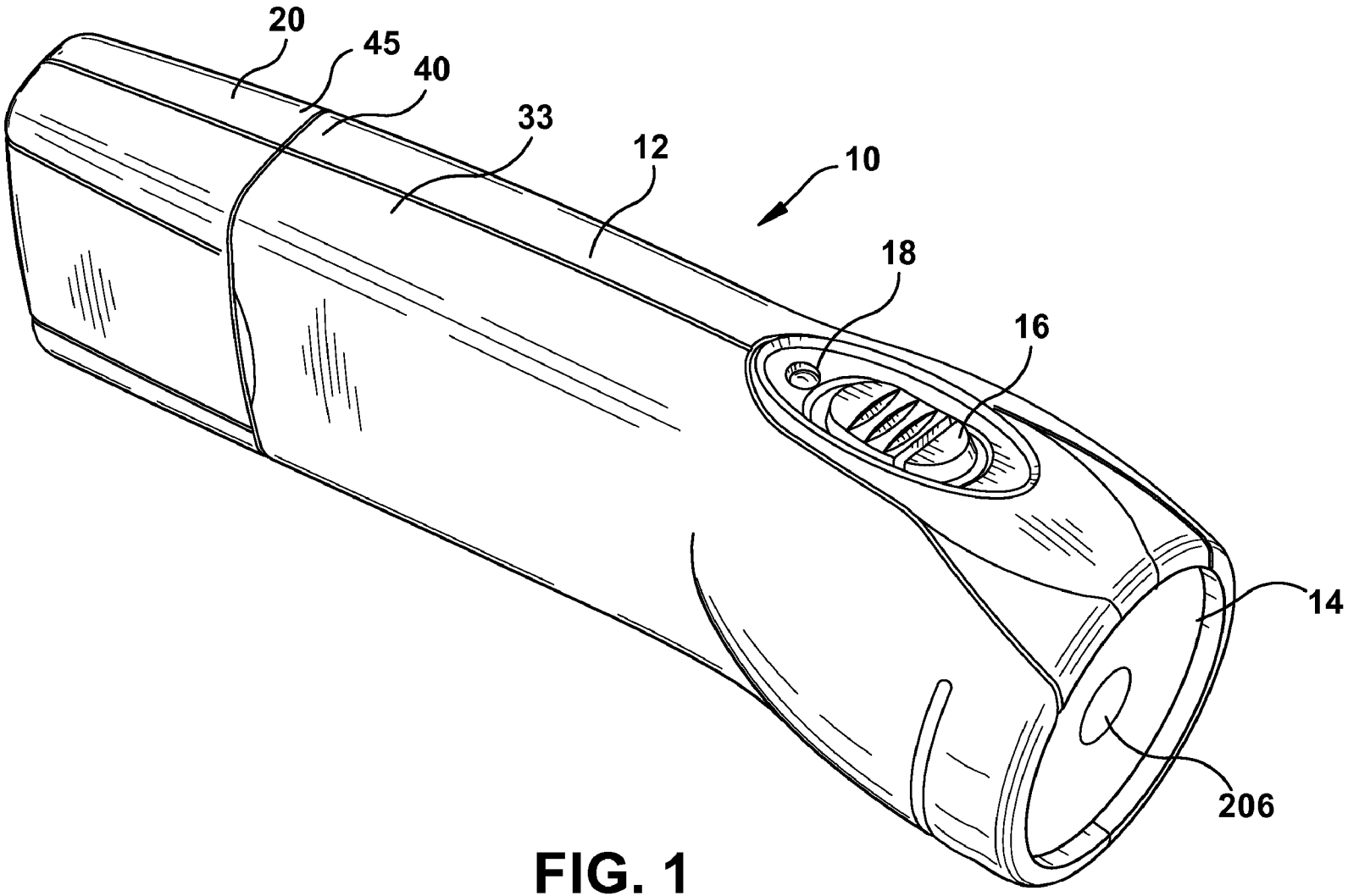
FIG. 1 illustrates a perspective view of a rechargeable flashlight.

Illustrated in FIG. 1 is a flashlight 10 which has a body 12 with a lens assembly 14 at its forward end. At the top of the body 12 is a three position switch 16 and a red LED 18 positioned behind the switch 16.

At the rear of the body 12 is located an adaptor 20. Illustrated in FIG. 3 the adaptor 20 has two electrical connectors 22 and 24 for insertion into a wall socket. The format of the electrical connectors 22 and 24 are to suit the spacing and shape required for European wall sockets and it will be understood that the shape and spacing of these can be varied according to requirements in various countries around the world.

The connectors 22 and 24 extend away from a hexagonally shaped male portion 26 which has cut always 28 and 30 on opposite sides leading to a recess 32 shown on the right side with a similar recess which is not visible on the left. (A left recess is visible in FIG. 5 and is labelled with the numeral 33.) The right side 34 of the adaptor 20 as illustrated in FIG. 3 will become the upper surface of the adaptor 20 when the adaptor 20 is in use in a wall socket as illustrated in FIG. 4.

Figure 5:
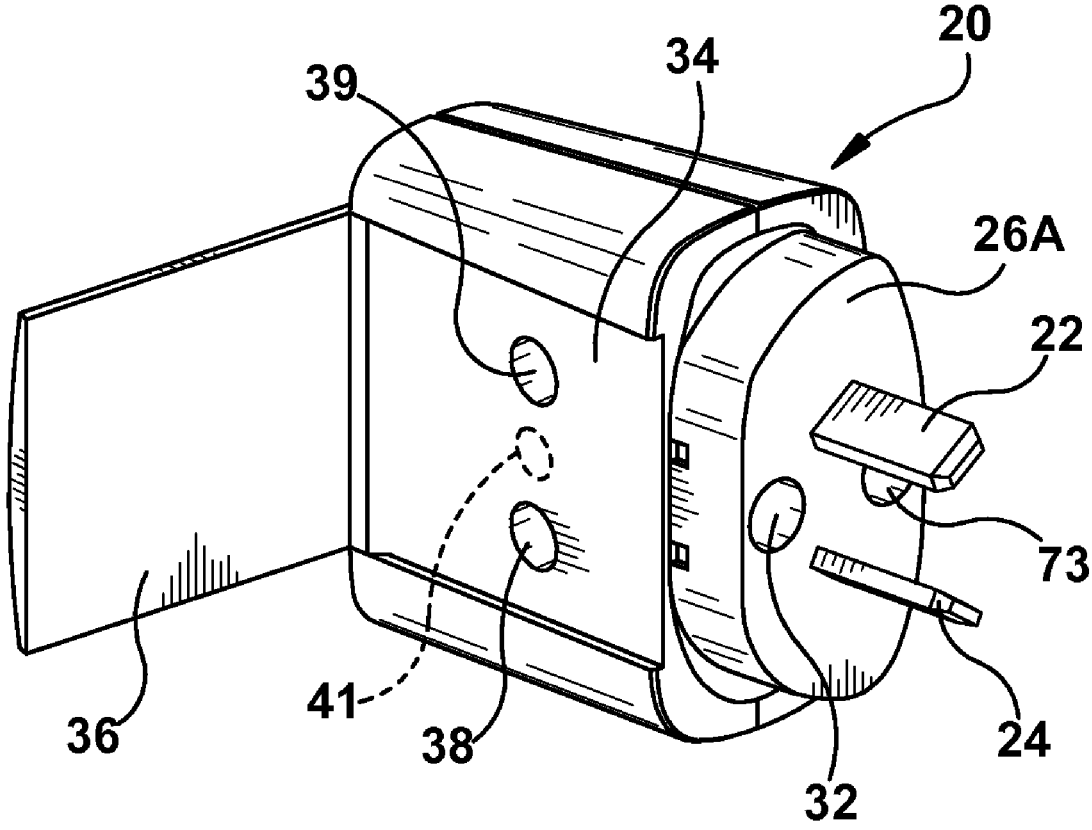
FIG. 5 illustrates an adaptor similar to FIG. 3 with a cover in the open position.

The side 34 has a rotating cover 36 which covers and protects the sockets 38 and 39 in the adaptor 20. In FIG. 5 the cover 36 is rotated to the open position.

Figure 3:
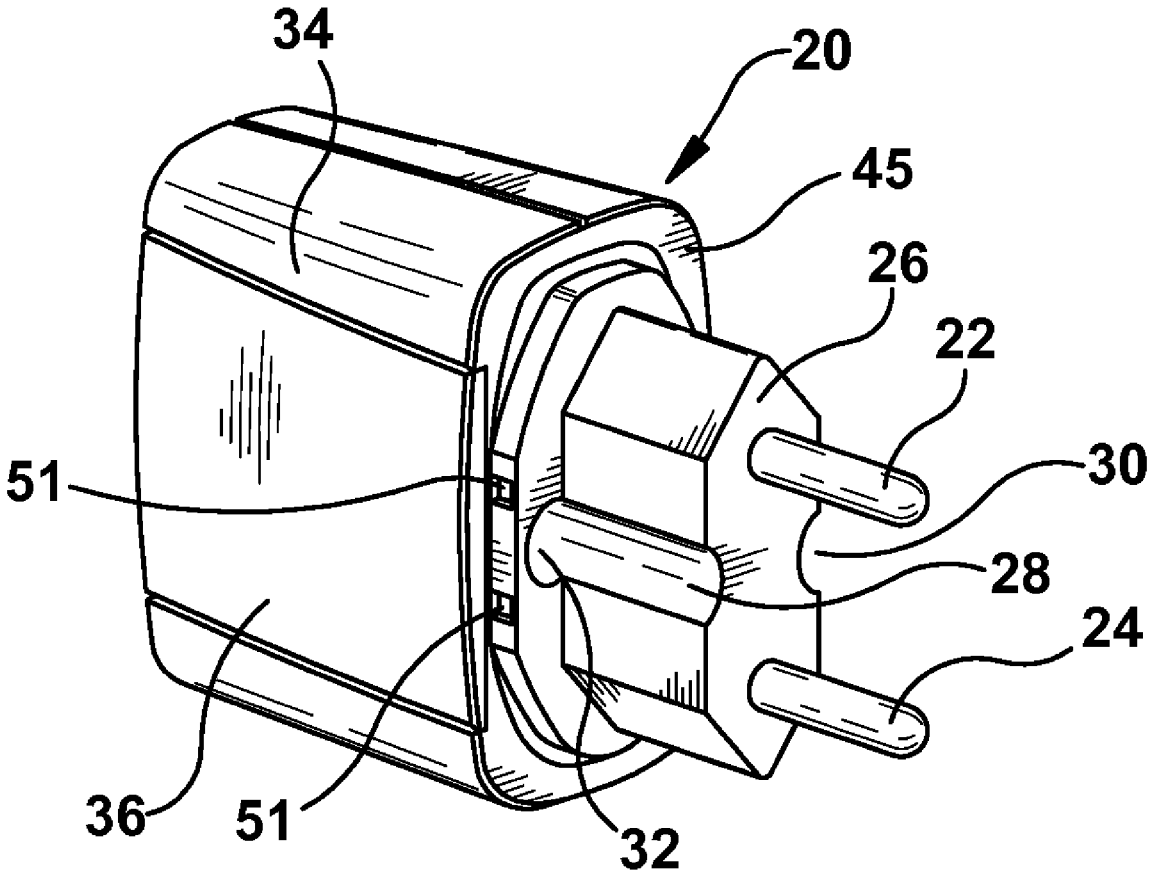
FIG. 3 illustrates a front perspective view of the rear adaptor of the flashlight of FIG. 1.
Figure 4:
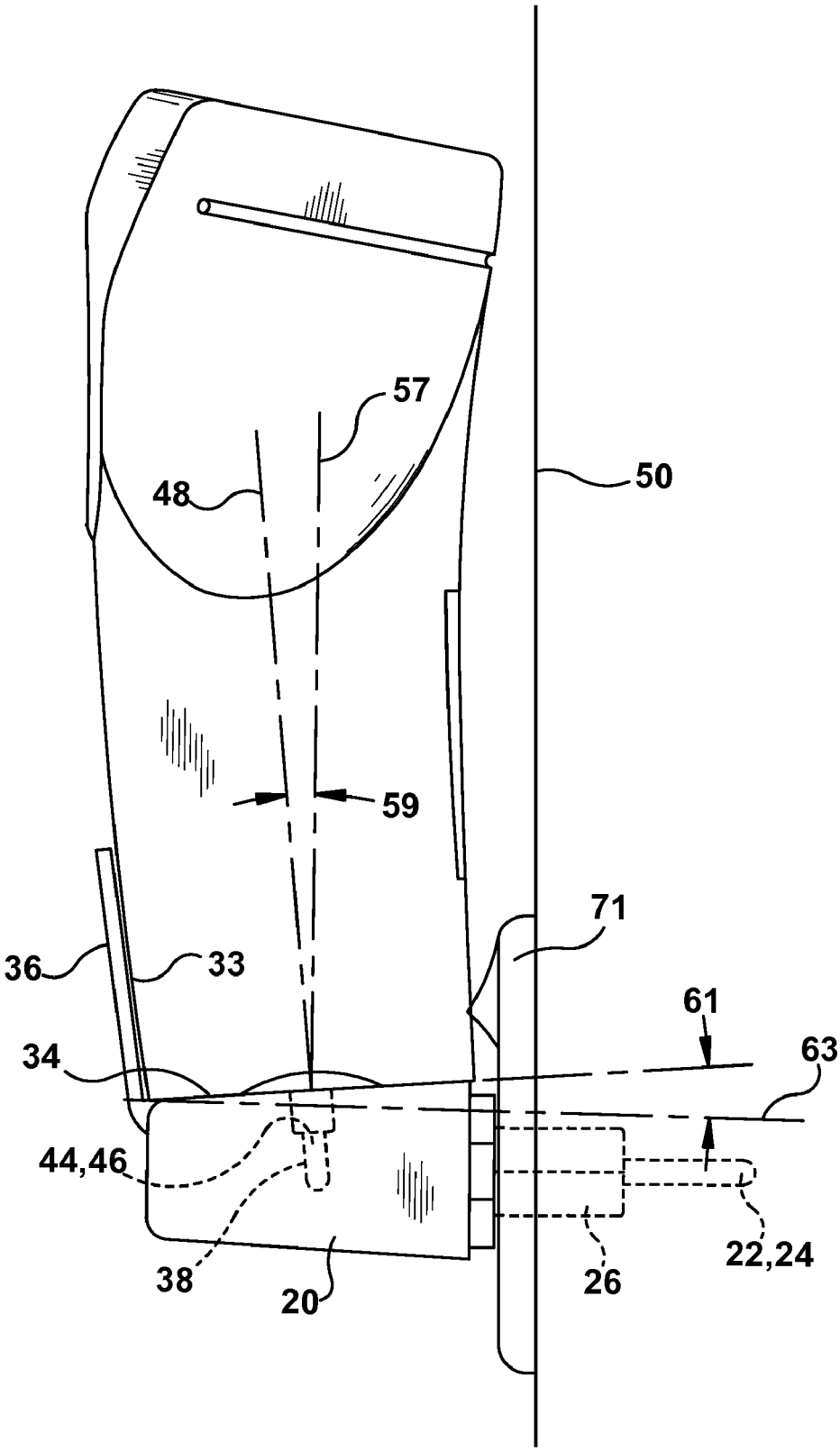
FIG. 4 illustrates the flashlight of FIG. 1 mounted on the adaptor and positioned in an electricity socket.

As can be seen from FIGS. 1 and 3, the shape of the adaptor 20 with the cover 36 closed, complements and finishes the rear of the flashlight body 12. The lines and starting point of the outward surfaces of the front 45 of the adaptor 20, blend with the lines and finishing point of the outward surfaces of the rear 40 of the flashlight body 12.

The rear 40 of the flashlight body 12 has a cavity 42, which has a complementary shaped hexagonal recess 43 to receive the hexagonal male portion 26 of the adaptor 20. The recess 43 receives the male portion 26 therein whilst the cavities 32 (and 73) at the sides of the hexagonal male portion 26 receive therein recharging terminals 44 and 46 which are of a generally cylindrical shape, and which project outwardly from the cavity 42. The hexagonal male portion 26 has shallow recesses 51 so that complementary shaped protrusions 53 on the cavity 42 can sit therein to lock the adaptor 20 and body 12 together, until sufficient force is applied to separate the two components.

While the above discussion and FIGS. 1, 2, 3 and 4 utilise a recess 43 and male portion 26 which are generally hexagonal in shape, this hexagonal shape is only a preferment. As can be seen from FIG. 5, a different shaped male portion 26A is used.

As can be seen from FIG. 4, the side 34, when in situ in a wall socket is upwardly facing. It will also be noted from the side elevation of FIG. 4, that an imaginary line 48, which is normal or perpendicular to the side 34, divergently extends away from the adaptor 20, at an angle 59 from the vertical 57 represented by the wall 50, to which the socket 47 is attached.

This angle 59 also has the same magnitude as the angle 61 which is the angle between the side 34 and the horizontal 63, as shown in FIG. 4.

The angles 59 and 61 are approximately 8° but can be in the range of 5° to 30°. This angle allows the flashlight body, to rest on the adaptor 20 in an equilibrium condition due to the flashlight body 12 having a contoured forward end whereby the lighting means and lens assembly 14 are oriented at an angle to the longitudinal axis of the rest of the flashlight body 12. The cover 36 also opens outwardly to an angle of similar magnitude as angle 59, so as to provide support to the rear end 40 of the flashlight body 12, by engaging the face 33, which is located on the top (when the flashlight is in the orientation of FIG. 1) of the body 12. This helps to keep the flashlight 10 in position on the adaptor 20 and limits the movement which may separate the flashlight 10 from the adaptor 20. The movement is thus limited to a side to side movement, generally parallel to the wall 50 in which the power socket is located, and not toward or away from the wall 50.

Once the adaptor 20, is located in a power socket 71 which is then switched on, then the rechargeable batteries in the flashlight 10 will be recharged.

During recharging the LED will switch on intermittently. Once full recharging has occurred, the LED will be lighted continuously.

Once recharging has occurred, the flashlight can be simply taken off the adaptor 20, and is useable without the adaptor 20 being reconnected to the rear of the flashlight.

However, for aesthetic purposes the adaptor 20 can be reconnected to the rear 40 of the body 12.

The two position switch 16 has an intermediate off position and a first on position which lights the lamp means with a low level current. The second on position will light the lamp means with a relatively high level current.

The lamp means is preferably provided by means of 1 or more LEDs.

By using LED's the flashlight will have a relatively long run time before the rechargeable batteries are drained.

Alternatively other type of lamp means can be utilised.

Figure 2:
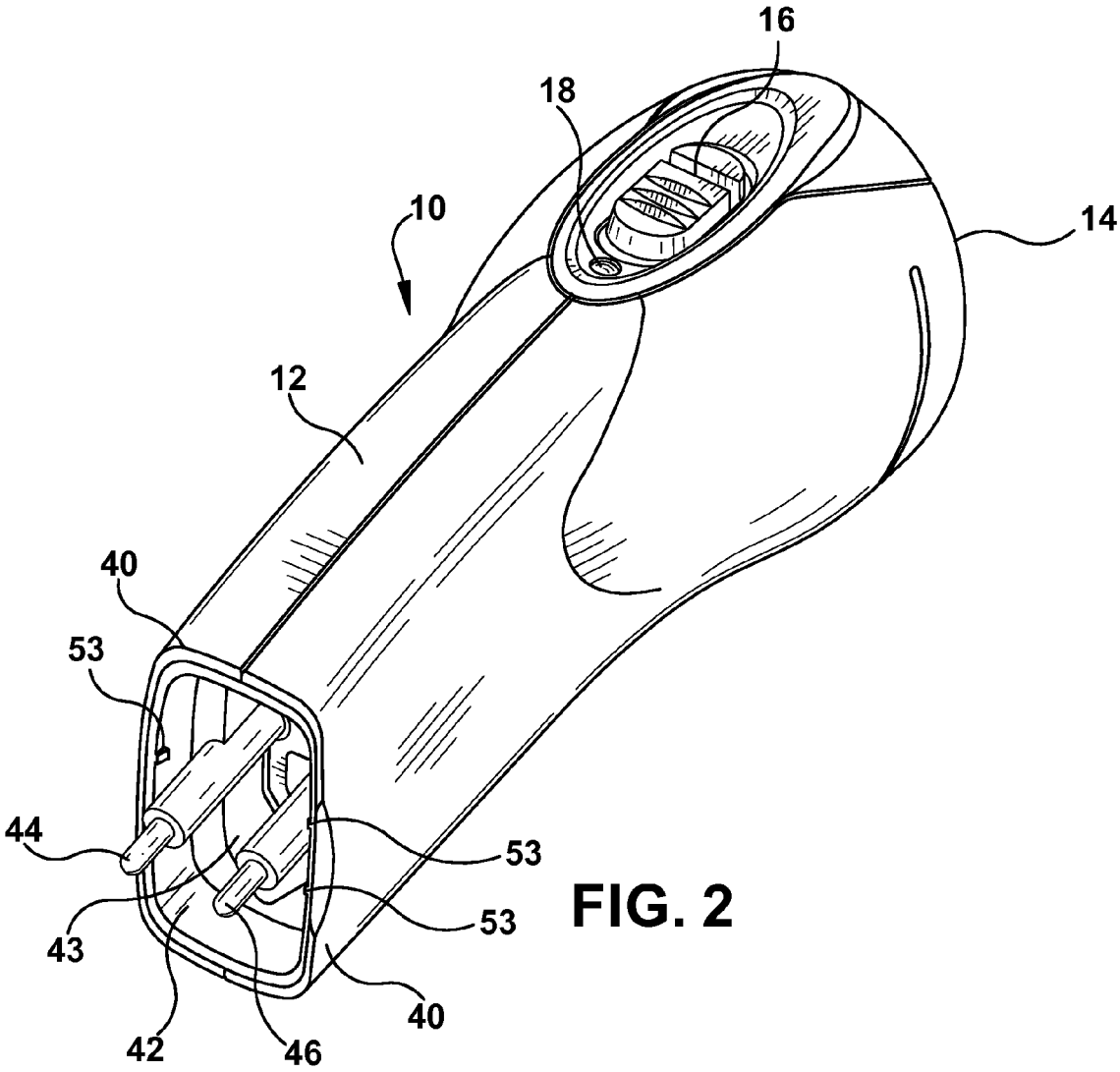
FIG. 2 illustrates a rear perspective view of the flashlight of FIG. 1 with the rear adaptor removed.
Figure 9:
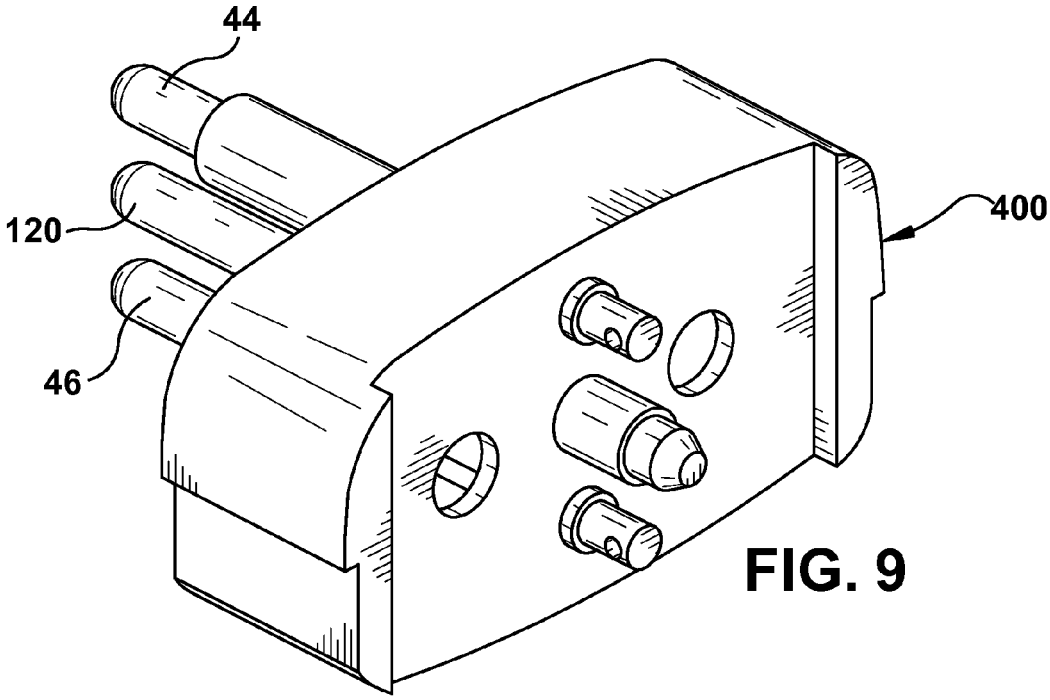
FIG. 9 illustrates a perspective view of a flashlight body's end having three pins.
Figure 10:
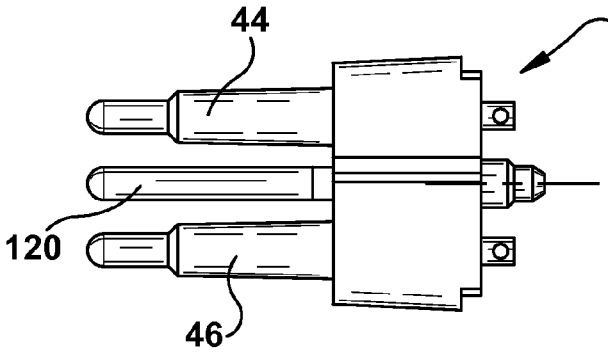
FIG. 10 is a side elevation of FIG. 9.
Figure 11:
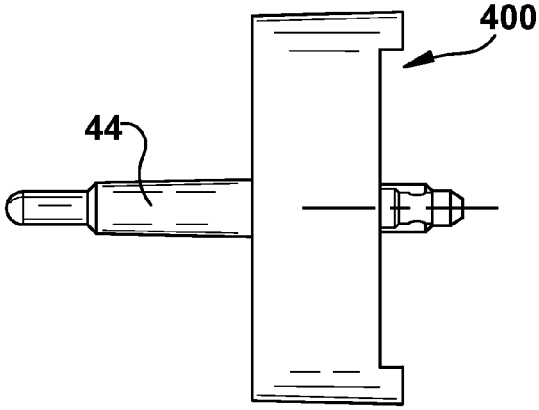
FIG. 11 is a plan view of FIG. 9.

As can be seen in FIG. 2, the flashlight 10 has the two terminals 44 and 46 extending away from the rear thereof The terminals 44 and 46 are mounted in and extend away from a plug member which is assembled, captured and held by the rear end of the flashlight 10 when it is assembled. However, in another embodiment, an alternative plug member 400 as illustrated in FIG. 9 to 11 can be utilised for assembly into, capture and holding by the rear end of the flashlight 10. The plug 400 includes the terminals 44 and 46, as well as an additional central pin 120. The pin 120 will prevent a terminal 44 or 46 from being inserted into an aperture 38 or 39 in such a manner that would otherwise have had the other terminal 46 or 44 exposed on the outside of the adaptor 20. The pin 120 performs this preventative task because unless the terminals 44 and 46 and pin 120 are aligned with apertures 38 and 39 and a third aperture 41 (see FIG. 5) then the terminals 44 and 46 will not individually be able to enter the adaptor 20.

Other means to prevent improper use can be provided such as shutters 100 and 130 in FIGS. 6 and 7, which will now be described.

Figure 6:
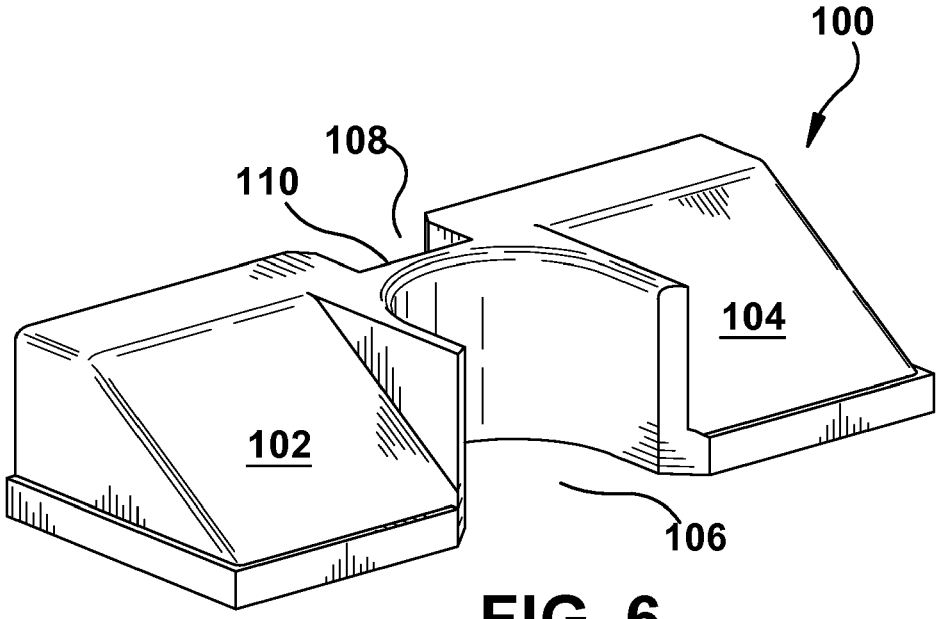
FIGS. 6 and 7 illustrate perspective views of shutter members.

Illustrated in FIG. 6 is a shutter member 100 for use with a flashlight having a plug 400 of FIGS. 9 to 11. The shutter 100 has two angled faces 102 and 104 at its ends. The angle on the faces 102 and 104 is approximately 45° to the base of the shutter 100. Between the angled faces 102 and 104 is a bight 106. The faces 102 and 104 will be engaged by terminals 44 and 46 on the flashlight 10, whereas the bight 106 can receive central third pin 120. Behind the bight 106 is a three sided recess 108 which has a central face 110. The face 110 and recess 108 receives the end of a compression spring 114 (see FIG. 8) and provides a bearing surface for the end of the spring 114 to push against.

Figure 8:
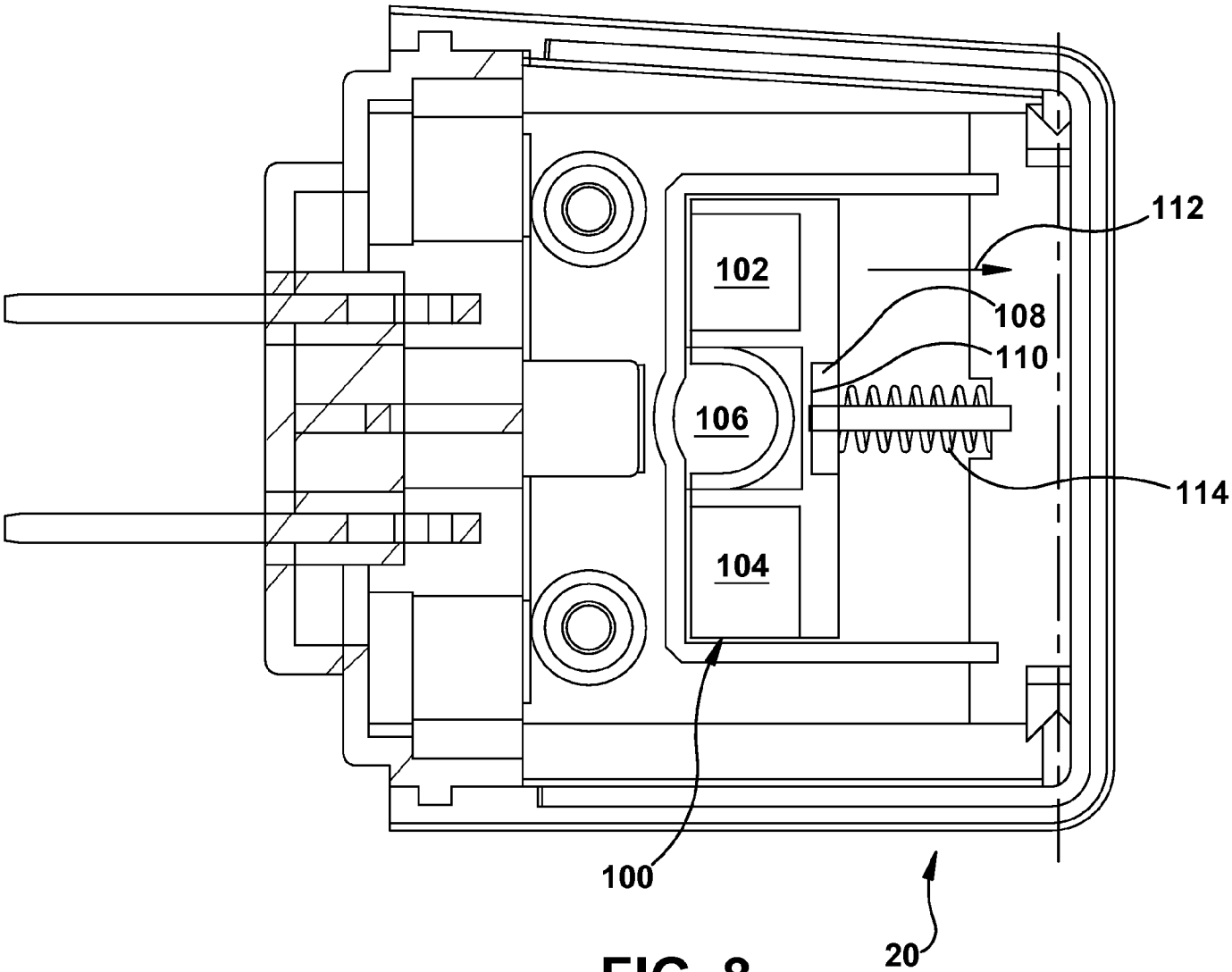
FIG. 8 illustrates the shutter member of FIG. 6 assembled into an adaptor.

The shutter member 100 can be made of injection molded plastic and located or assembled in the adaptor 20 as illustrated in FIG. 8 so that the faces 102 and 104 overlie the contacts (no illustrated) which will be engaged by terminals 44 and 46. The shutter system 100 can be utilised with a flashlight similar to that of FIG. 2 having only two terminals (44 and 46) but it is thought to be best used with a flashlight having three pins: namely terminals 44 and 46 and central pin 120 (see FIGS. 9, 10 and 11).

The terminals 44 and 46 will pass through apertures 38 and 39 in the adaptor 20 while pin 120 will pass through a central aperture 41 (see FIG. 5 where it is indicated in dashed linework). The terminals 44 and 46 will engage the surfaces 102 and 104 respectively to thereby push the shutter 100 in a rearward direction 112 against the bias of the spring 114 which is illustrated in FIG. 8. As the shutter 100 moves in the direction of arrow 112 further pushing of the rear of the flashlight 10 towards the adaptor 20 will mean that the shutter 100 will move completely out of the way of the terminals 44 and 46 allowing the terminals 44 and 46 ultimately push past the shutter 100 so as to engage the contacts located below the shutter 100. As the terminals 44 and 46 are moving inward, the pin 120 will simultaneously pass through the central aperture 41 and into the bight 106 which will not interfere with the movement of the shutter 100 in the direction of 112.

When the terminals 44 and 46 push past the shutter 100 and engage the contacts below the shutter 100 the recharging process can begin once the adaptor 20 is inserted into a power socket, which can then be switched on.

Figure 7:
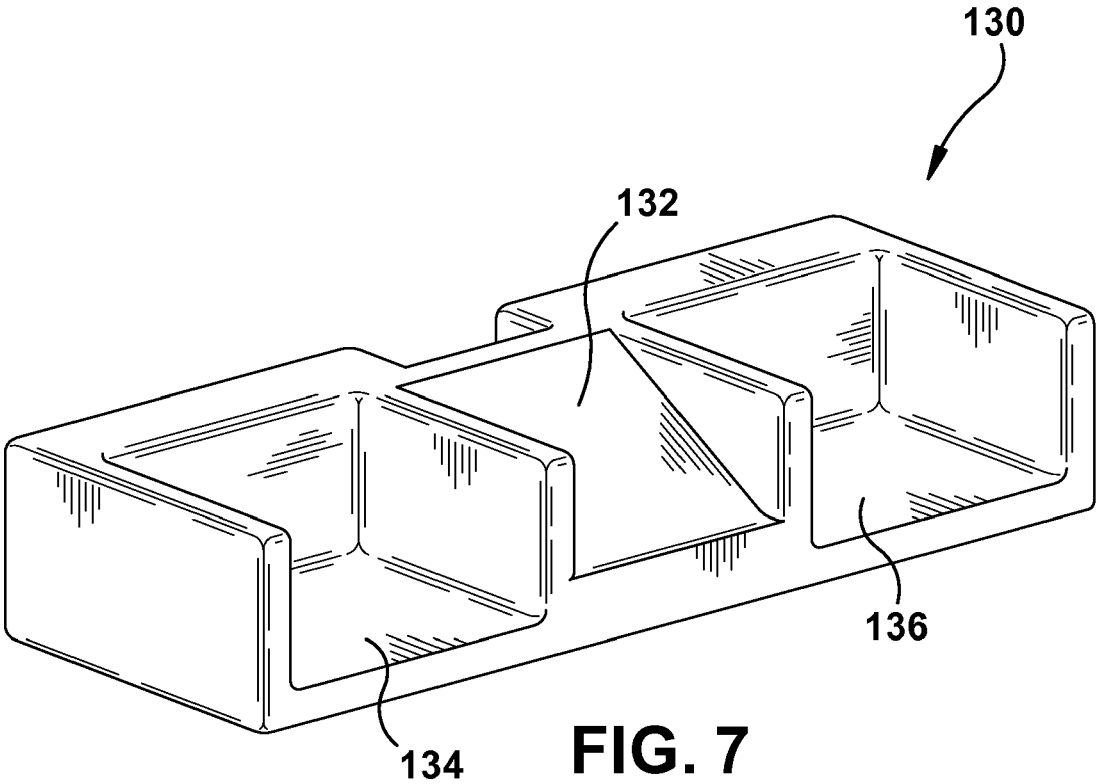

Illustrated in FIG. 7 is another shutter 130 which has only a central angled face 132 (being at an angle of approximately 45° to the base of the shutter 130) and flat faces 134 and 136 on either side thereof. The shutter 130 operates in much the same manner as the shutter 100 except that the shutter 130 will move in the direction of arrow 112 only when the central pin 120 engages the angled face 132. Thus should the pin 120 fracture or otherwise break the terminals 44 and 46 will not cause the shutter 130 to move in the direction 112, as they will perpendicularly engage the flat faces 134 and 136, thereby preventing access to the contacts below the shutter 130. Contrasted with this the shutter 100 of FIG. 6 will continue to perform even if the central pin 120 were not present, as the shutter 100 will still move in the rearward direction 112. Thus the shutter 130 is inherently better in operation than the shutter 100.

The central pin 120 if utilised with a shutter 100 serves the purpose of preventing the terminal 44 or 46 from being placed into one of the apertures 38 or 39 with the other terminal 46 or 44 being left in an exposed condition outside of the adaptor 20. However, in an embodiment which utilises the shutter 130, the central pin 120 has the additional purpose of moving the shutter 130 to its open condition allowing the terminals 44 and 46 to gain access to the contacts located underneath the shutter.

Figure 12:
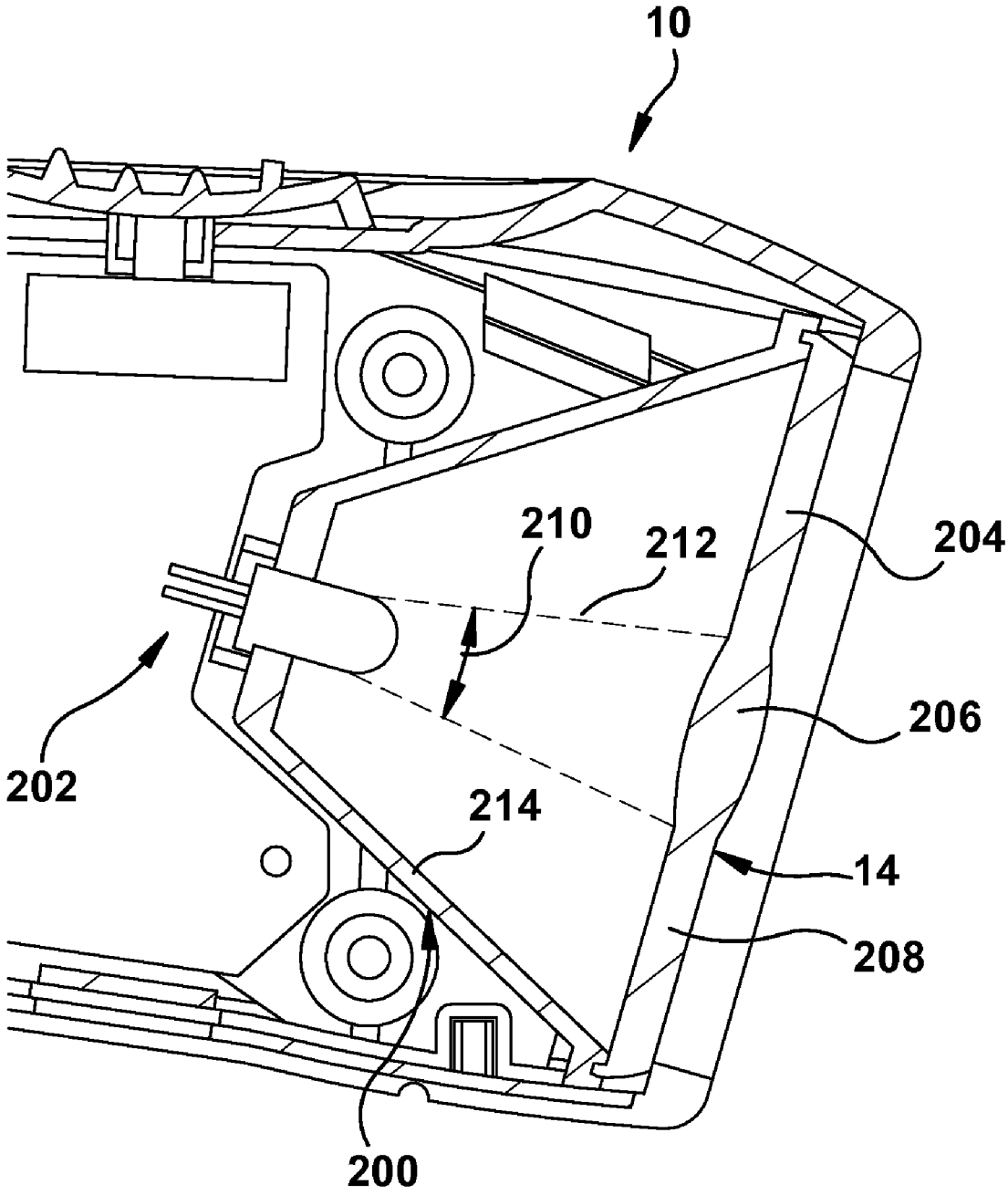
FIG. 12 is a cross section through the forward end of the flashlight of FIG. 1.

Illustrated in FIG. 12 is a cross section through the reflector and lens assembly 14 of flashlight 10 of FIG. 1. As can be seen from FIG. 12 flashlight 10 has a lens assembly 14 which consists of a conical reflector 200 in which is centrally positioned a white LED 202, The lens assembly 14 also includes a lens 204 which has a double convex central lens portion 206 (which can also be seen in FIG. 1) surrounded by an annular straight sided lens portion 208, The lens 206 is positioned at a suitable distance from the LED 202 so that when the cone angle 210 of the LED 202 is taken into consideration, the outside diameter of the double convex lens portion 206 is positioned away from the LED 202 so that it will be struck by the cone of light 212 when the cone has a diameter of substantially the same dimension as the diameter of the lens 204. The annular straight sided portion 208 of the lens 204 will transmit the light from LED 202 which is reflected off the walls 214 of conical reflector 200. This will produce the effect of a concentrated central beam with a less bright halo concentrically arranged around the centre of the central beam.

Figure 13:
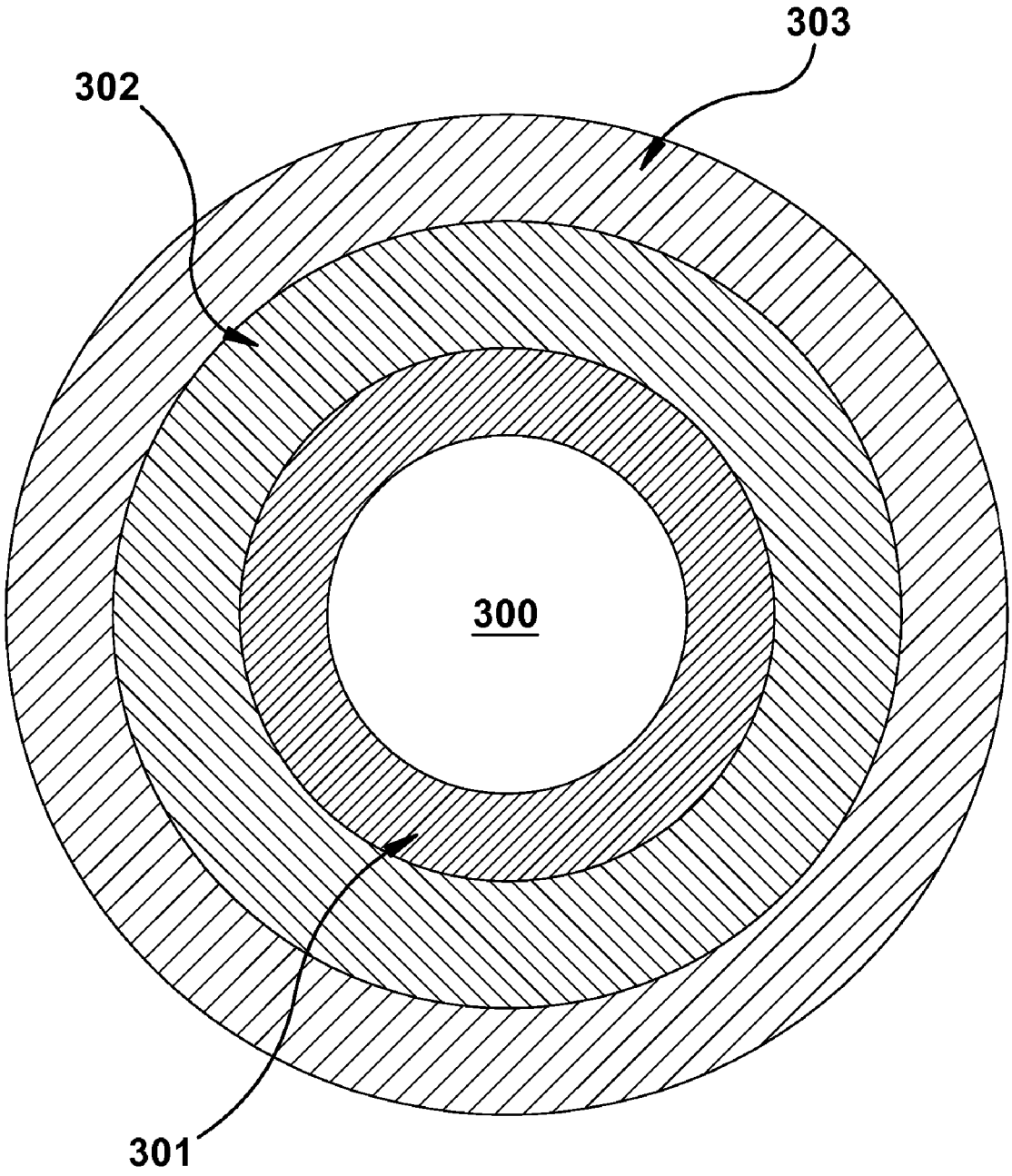
FIG. 13 is a schematic representation of the light output of the lens assembly of FIG. 12.

It has also been noticed that this reflector and lens assembly 14 will produce a series of concentric rings as illustrated in FIG. 13, whereby the centre portion 300 is the brightest with at least three annular bands 301, 302 and 303 around the centre 300. The first annular band 301 is a relatively dark ring (darker than the outer two annular bands 302 and 303 and the centre portion 300). The second annular band 302 is brighter than the third annular band 303, but is of less intensity than the centre portion 300. This effect has been found to produce a useful light output even though only relatively little power is being consumed from the power source.

The bands 301, 302 and 303 are illustrated as being homogenous, however, in practice the bands 301, 302 and 303 may be interspersed with flecks of light or possibly thin lines of light.

Due to the power plug requirements of some countries, the adaptor used may need to be of a shape and size which will not permit the adaptor to be attached, when not in use, to the rear of the flashlight. Thus such an adaptor can be stored separately from the flashlight, with an end cap being provided to cover the terminals 44 and 46 at the rear of the flashlight, when recharging is not required While some of the features of the adaptor 20 would not be required on such an adaptor, such an adaptor can include the shutter systems described above to attempt to prevent misuse.

It will be understood that the invention disclosed and defined herein extends to all alternative combinations of two or more of the individual features mentioned or evident from the text or drawings. All of these different combinations constitute various alternative aspects of the invention.

The foregoing describes embodiments of the present invention and modifications, obvious to those skilled in the art can be made thereto, without departing from the scope of the present invention.

The invention claimed is:

1. A device comprising:

a body having a battery and recharging in terminals for recharging the battery;

an adaptor having an electrical connector, wherein the electrical connector is in a power supply socket with a vertically oriented front face;

a structural connection to releasably connect the body and the adaptor;

an electrical connection to releasably electrically connect the recharging terminals and the electrical connector of the adaptor, the recharging terminals being able to be received in the adaptor and the electrical connector being able to be received in the body when the adaptor is not in use for recharging; and wherein the adaptor has an upper face into which the rechargeable terminals are inserted, the upper face being at an angle to the horizontal so that a line normal to the upper face extends away from the adaptor on a divergent path away from the vertical.

2. The device of claim 1, the body further having a lens assembly at one end.

3. The device of claim 1, the body further having one or more light emitting diodes at one end and a circuit connected to the one or more light emitting diodes and the battery.

4. The device of claim 1, wherein the structural connection is located on the body.

5. The device of claim 1, wherein the structural connection includes a female portion on one of the body or the adaptor, with the other having a male portion.

6. The device of claim 1, wherein a portion of the structural connection is located on the body and has the recharging terminals extending therefrom.

7. The device of claim 1, wherein the adaptor includes sockets for receiving the recharging terminals.

8. The device of claim 1, wherein the electrical connector connects to a power supply.

9. The device of claim 1, wherein the adaptor is shaped so that when the structural connection means connects the body and the adaptor, the adaptor is a rear part of the body.

10. The device of claim 1, wherein the body has a female portion and the adaptor has a male portion.

11. The device of claim 1, wherein the adaptor includes a hinged cover to overlay the electrical connection on the adaptor.

12. The device of claim 1, wherein the adaptor includes a shutter to cover contacts used to recharge the device.

13. A device comprising:

a body having a battery, a lamp, and a circuit there between the battery and the lamp and recharging terminals for recharging the battery;

an adaptor having an electrical connector and sockets for receiving the recharging terminals, the adaptor further comprising a hinged cover;

a structural connection to releasably connect the body and the adaptor;

an electrical connection to releasably electrically connect the recharging terminals and the electrical connector of the adaptor, the recharging terminals being able to be received in the sockets of the adaptor and the electrical connector being able to be received in the body when the adaptor is not in use for recharging; and wherein the hinged cover acts to limit movement of the device on the adaptor when they are electrically connected.

14. The device of claim 13, wherein the adaptor includes a hinged cover to overlay the electrical connection means on the adaptor.

15. The device of claim 13, wherein the adaptor includes a shutter to cover contacts used to recharge the device.

16. A device comprising:

a body having a battery, a lamp, and a circuit there between the battery and the lamp recharging terminals for recharging the battery;

an adaptor having an electrical connector and sockets for receiving the recharging terminals, the adaptor further comprising hinged cover;

a structural connection to releasably connect the body and the adaptor;

an electrical connection to releasably electrically connect the recharging terminals and the electrical connector of the adaptor, the recharging terminals being able to be received in the sockets of the adaptor and the electrical connector being able to be received in the body when the adaptor is not in use for recharging; and wherein between the recharging terminals there is located a central pin which is as coextensive as the terminals.

17. A device comprising:

a body having a battery and recharging terminals for recharging the battery;

a adaptor having an electrical connector, wherein the electrical connector is in a power supply socket with a vertically oriented front face;

a structural connection to releasably connect the body and the adaptor;

an electrical connection to releasably electrically connect the recharging terminals and the electrical connector of the adaptor, the recharging terminals being able to be received in the adaptor and the electrical connector being able to be received in the body when the adaptor is not in use for recharging; and wherein a hinged cover acts to limit movement of the device on the adaptor when they are electrically connected.

18. A device comprising:

a body having a battery and recharging terminals for recharging the battery;

an adaptor having an electrical connector, wherein the electrical connector is in a power supply socket with a vertically oriented front face;

a structural connection to connect the bad and the adaptor;

an electrical connection to releasably electrically connect the recharging terminals and the electrical connector of the adaptor, the recharging terminals being able to be received in the adaptor and the electrical connector being able to be received in the body when the adaptor is not in use for recharging; and wherein between the recharging terminals there is located a central pin which is as coextensive as the terminals.

19. A device comprising:

a body having a lamp, a battery and a circuit there between and recharging terminals for recharging the battery;

an adaptor having an electrical connector, a shutter and sockets for receiving the recharging terminals, the electrical connector being able to be received in the body when the adaptor is not in use for charging;

a structural connection to releasably connect the body and the adaptor; and wherein a hinged cover acts to limit movement of the device on the adaptor when they are electrically connected.

20. A device comprising:

a body having a lamp, a battery and a circuit there between and recharging terminals for recharging the battery;

an adaptor having an electrical connector, a shutter and sockets for receiving the recharging terminals, the electrical connector being a able to be received in body when the adaptor is not in use for charging;

a structural connection to releasably connect the body and the adaptor; and wherein between the recharging terminals there is located a central pin which is as coextensive as the terminals.

21. The device of claim 20, the body further having a switch coupled to the circuit that includes an off position, a first on position that lights the lamp with a low level current and a second on position that lights the lamp with a relatively high level current.

22. The device of claim 20, the body further having a recharging LED coupled to the circuit that indicates charging and once fill charging has occurred.

23. The device of claim 20, wherein the adaptor includes a hinged cover to overlay the electrical connection on the adaptor.

24. The device of claim 20, wherein the shutter is operable to cover contacts used to recharge the device.

* * * * *